United States Patent [19]

Cumpston

[11] Patent Number: 4,678,127

[45] Date of Patent: Jul. 7, 1987

[54] PUMPED FLOW ATTRITION DISK ZONE

[76] Inventor: Edward H. Cumpston, 6 Stonehedge Dr., Bennington, Vt. 05201

[21] Appl. No.: 659,408

[22] Filed: Oct. 10, 1984

Related U.S. Application Data

[63] Continuation-in-part of Ser. No. 461,025, Jan. 26, 1983, abandoned, which is a continuation-in-part of Ser. No. 303,997, Sep. 21, 1981, abandoned.

[51] Int. Cl.[4] ..... B02C 7/12

[52] U.S. Cl. ..... 241/46.04; 241/46.06; 241/261.3

[58] Field of Search ..... 241/21, 46.04, 46.06, 241/97, 46.11, 261.2, 46.17, 261.3, 80, 297, 161, 162, 163, 46 R, 257 R, 258, 152 A, 55; 162/4

[56] References Cited

U.S. PATENT DOCUMENTS

| | | | |
|---|---|---|---|
| 254,813 | 3/1882 | Gathmann | 241/261.3 |
| 254,814 | 3/1882 | Gathmann | 241/261.3 |
| 1,814,587 | 7/1931 | Daniels | 241/261.2 |
| 3,415,456 | 12/1968 | Bidwell | 241/55 X |
| 3,506,202 | 4/1970 | Cumpston, Jr. | 241/46.04 X |
| 3,523,649 | 8/1970 | Laakso | 241/297 X |
| 3,771,732 | 11/1973 | Cumpston, Jr. | 241/46.11 |
| 4,027,824 | 6/1977 | Fuller | 241/152 A |
| 4,057,194 | 11/1977 | Orton | 241/261.2 X |
| 4,166,584 | 9/1979 | Asplund | 241/261.3 |
| 4,440,352 | 4/1984 | Rossler | 241/152 A |

*Primary Examiner*—Mark Rosenbaum

*Attorney, Agent, or Firm*—Stonebraker, Shepard & Stephens

[57] ABSTRACT

A disk attrition device 10 or 50 for pulping or refining slurried material has a centrifugal rotor pump that reverses the flow of material through the attrition zone 13 between rotor and stator working bars. Rotor 12 has centrifugal pump vanes 20 axially near attrition zone 13 and disposed around a peripheral pumping region 17, and rotor 12 has a hollow interior 30 extending from the inner periphery of the attrition zone to the pumping region. Pump vanes 20 provide sufficient centrifugal pumping force so that slurried material enters the outer periphery of the attrition zone, passes radially inward through the attrition zone against the outward pumping force of the working bars, and flows through the hollow rotor interior to the pumping region, where it is pumped radially outward.

29 Claims, 8 Drawing Figures

PUMPED FLOW ATTRITION DISK ZONE

RELATED APPLICATIONS

This application is a continuation-in-part of my parent application Ser. No. 461,025, filed Jan. 26, 1983, entitled REVERSE FLOW DISK ATTRITION DEVICE, abandoned and Ser. No. 461,025 was a continuation-in-part of its parent application Ser. No. 303,997, filed Sept. 21, 1981, entitled Pumping Attrition Device for Pulping or Refining Cellulose Fiber Slurry, which has been abandoned.

BACKGROUND

I have discovered a better way of operating an annular, disk-shaped attrition zone for working slurried material in pulpers and refiners. The turning rotor bars that confront stator bars in such attrition zones centrifugally pump the slurry radially outward from the inside to the outside of the attrition zone as the bar crossings work the material flowing through.

Such centrifugally pumping, annular attrition zones experience many problems. In pulpers, they need a cleaner to keep large clumps of fiber from plugging the inside entrance to the attrition zone, and cleaners find it difficult to exclude contaminants and overly large fiber clumps while admitting suitable slurry to the attrition zone. The pumping force of the attrition zone, especially when combined with a restrictive cleaning bonnet, creates a high vacuum under the rotor. Resisting the substantial force of this vacuum requires a strong rotor, a large thrust bearing, an elaborate packing gland around the rotor shaft, and a sturdy mechanism for moving the rotor axially to adjust the bar clearance gap in the attrition zone.

SUMMARY OF THE INVENTION

I have discovered that reversing the flow through the attrition zone by means of a pump on the rotor creates several surprising advantages. The dynamic movement of the working bars in the attrition zone can keep out contaminants and prevent fiber clogging, thus eliminating any separate cleaning bonnet. The self-cleaning ability of the attrition zone also protects the rotor pump, which receives worked slurry from the attrition zone as an input. The vacuum under the rotor can be greatly reduced or eliminated, simplifying construction of the rotor and its adjusting mechanism. The much larger entrance area to the attrition zone and the inward flow of slurry through the attrition zone make my device surprisingly aggressive and effective--both shortening the time required to work a slurry and allowing defibering of previously unworkable materials.

DRAWINGS

DETAILED DESCRIPTION

General Structure

Figure 1:
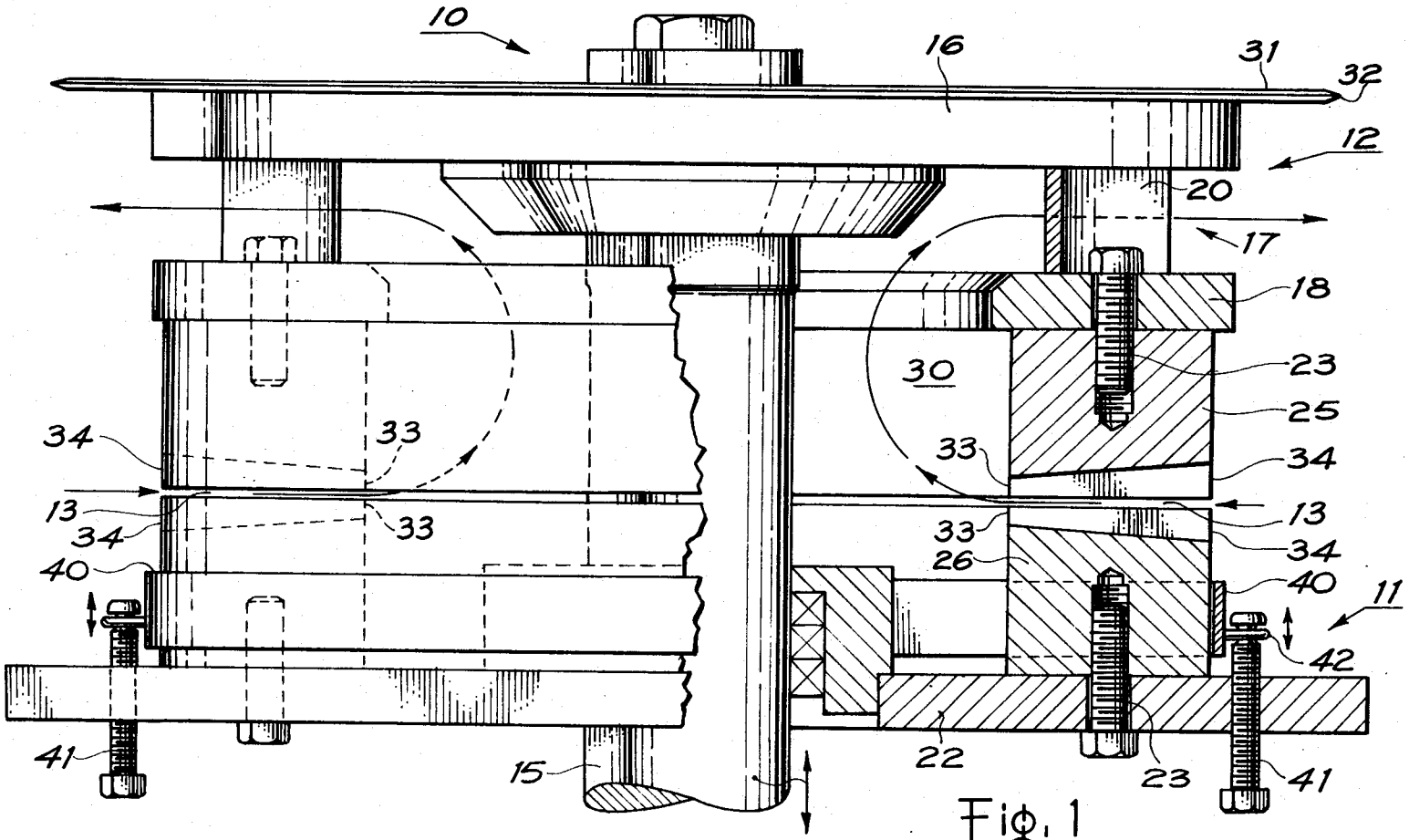
FIG. 1 is a partially schematic cross-sectional view of a preferred embodiment of a disk attrition device made according to my invention.
Figure 3:
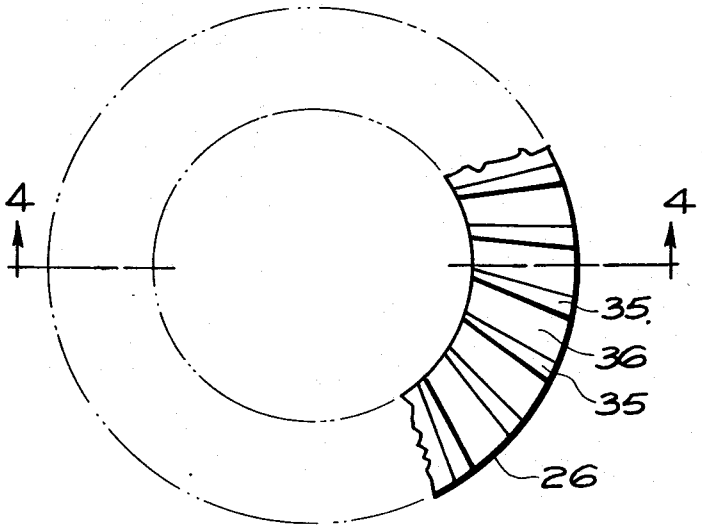
FIG. 3 is a plan view of a working bar element for the device of FIGS. 1 and 2.
Figure 4:
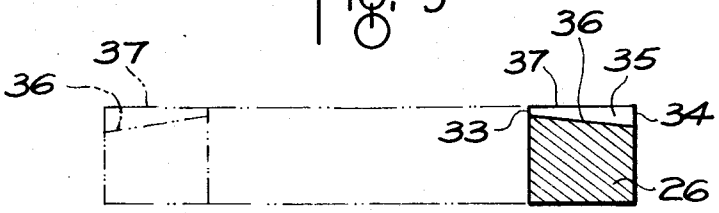
FIG. 4 is a cross-sectional view of the working bar element of FIG. 3, taken along the line 4—4 thereof.

Attrition device 10 as shown in the drawings in simplified for illustration by eliminating some generally known mechanical parts. This unclutters the drawings and makes the essential operating components more clear.

Device 10 includes a stator 11 and a rotor 12, each bearing an annular, disk-shaped array of working bars described more fully below. Stator and rotor bars confront across a narrow gap 13 forming a disk-shaped attrition zone that extends around a radially outer region of the rotor and stator in a plane perpendicular to the rotor axis.

Rotor 12 is mounted on axial shaft 15 that rotates and is movable axially to adjust the width of attrition gap 13. A radial plate 16 is mounted on shaft 15 and extends to a slurry discharge region 17 at the outer periphery of rotor 12. An annular bar holding plate 18 is axially spaced from radial plate 16 and radially spaced from shaft 15. Centrifutal pump vanes 20 are arranged between, and preferably welded to, radial plate 16 and bar holding plate 18 so that pump vanes 20 interconnect plates 16 and 18. A replaceable annular filling 25 having working bars as described below is secured to bar holding plate 18.

Stator 11 includes a base plate 22 to which is clamped or bolted an annular filling 26 with working bars as explained below. Besides bolts 23, there are many possible arrangements of clamps and holding devices that can secure bar fillings 25 and 26 in place and allow their replacement when worn.

Mounting rotor bar filling 25 on radial plate 16 via pump vanes 20 and annular bar plate 18 makes a sturdy and simple rotor 12 with an open annular interior 30. No radial spokes are necessary, and hollow interior 30 is undivided by any radially extending elements. This, together with rounded or beveled edges within interior 30 ensures that fibers, wood splinters, or other materials being processed have no surfaces or edges on which to lodge. Rotor interior 30 extends in a generally annular U-turn from the inner perimeter 33 of attrition zone 13 to discharge region 17 swept by pump vanes 20.

Rotor 12 can have a cutting edge 32 extending beyond the outer perimeter of radial plate 16 for cutting large objects or groups of fibers into smaller pieces that are more easily defibered. I have found that a flat cutter plate 31 having a polygonal shape such as a hexagon and having a sharpened outer edge 32 makes a simple and effective cutter.

A stator guard 40, explained more fully below, is preferably formed as a metal strip or ring that encircles stator bar filling 26 and is axially adjustable via screws 41 engaged in loops 42 secured to guard band 40. Guard 40 is adjustable axially of stator 11 toward and away from attrition zone gap 13 to set a depth of space available between stator bars to control the type of material entering the attrition zone.

Structural details not illustrated include packing glands, bearings, means for rotating and axially adjusting shaft 15, and means for mounting device 10 within a tank or chamber. Structures for these purposes are generally known.

Attrition device 10 can be mounted in a tank to operate as a pulper or refiner for defibering fibrous material. It can also be arranged in a smaller chamber through which a slurry flows so that device 10 can serve as a refiner. Although I made device 10 with cellulose fibers in mind, I have found that it can defiber synthetic and other organic fibers. It may also be usable as a grinder or attrition device for reducing particle size or refining materials other than fibers.

The simple construction of device 10 makes it convenient for a small sized laboratory model that can operate in small containers to experiment with different materials. The same basic construction can also be scaled up to fullsized pulpers and refiners operating in large tanks or chambers at substantial throughput rates.

Figure 2:
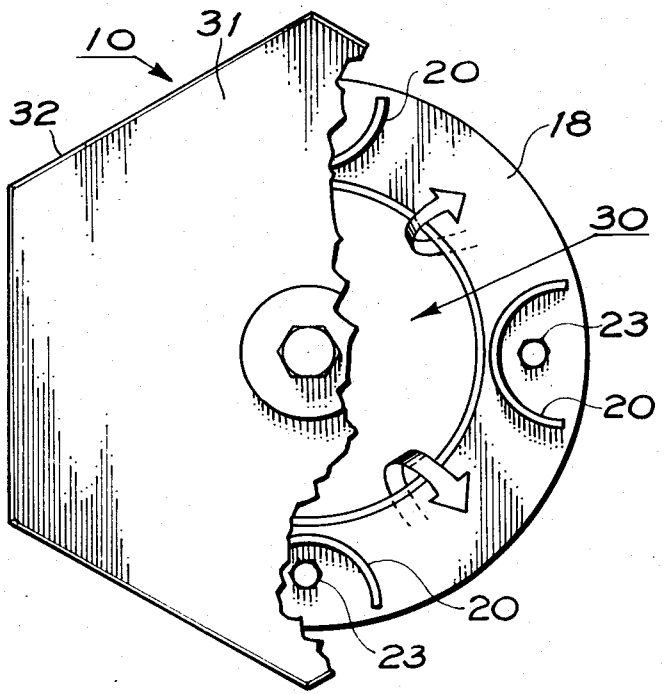
FIG. 2 is a partially cutaway plan view of the device of FIG. 1.
Figure 7:
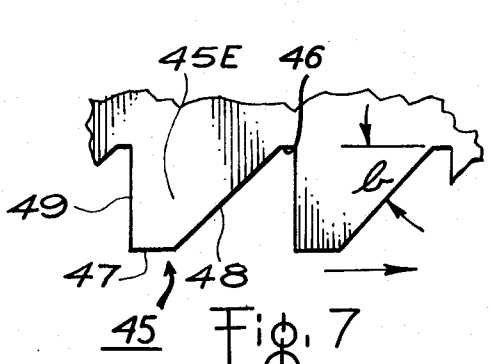
FIGS. 6 and 7 are schematic profiles of preferred working bar configurations for a stator and rotor respectively.

I prefer that pump vanes 20 be approximately semicylindrical as best shown in FIG. 2. Such vanes are simple to fabricate and afford excellent connectors between plates 16 and 18 for a simple and sturdy rotor construction. The semi-cylindrical shape of pumping vanes 20 also makes their radially inner surfaces rounded so that fibers cannot lodge on them. The illustrated version of device 10 has four pumping vanes 20, but other numbers can be used.

The centrifugal pumping force of annular pumping zone 17 swept by vanes 20 is sufficient to draw slurried material radially inward through attrition zone 13 against the outward pumping force of the working bars. To accomplish this, pump vanes 20 are preferably positioned radially outward far enough so that the outside diameter of pumping zone 17 is larger than the outside diameter of attrition zone 13. Also, the inside diameter of vanes 20 and pumping zone 17 is preferably larger than the inside diameter of attrition zone 13. The radially inward flow from the outer perimeter 34 to the inner perimeter 33 of attrition zone 13 leads to an annular U-shaped flow through hollow rotor interior 30 and a radially outward flow through pumping region 17. This reverse flow through attrition zone 13 is also rapid enough so that slurried material makes quickly repeated passes through the attrition zone to expedite material processing.

Pump vanes 20 also produce a swirling flow so that breaker or cleaner vanes on rotor 12 are no longer necessary to swirl slurried mterial around in a circulational flow. Eliminating breaker or circulation vanes on the rotor also eliminates the problem of large objects wrapping or lodging on such vanes so that device 10 can opeate cleanly with otherwise troublesome materials.

Figure 8:
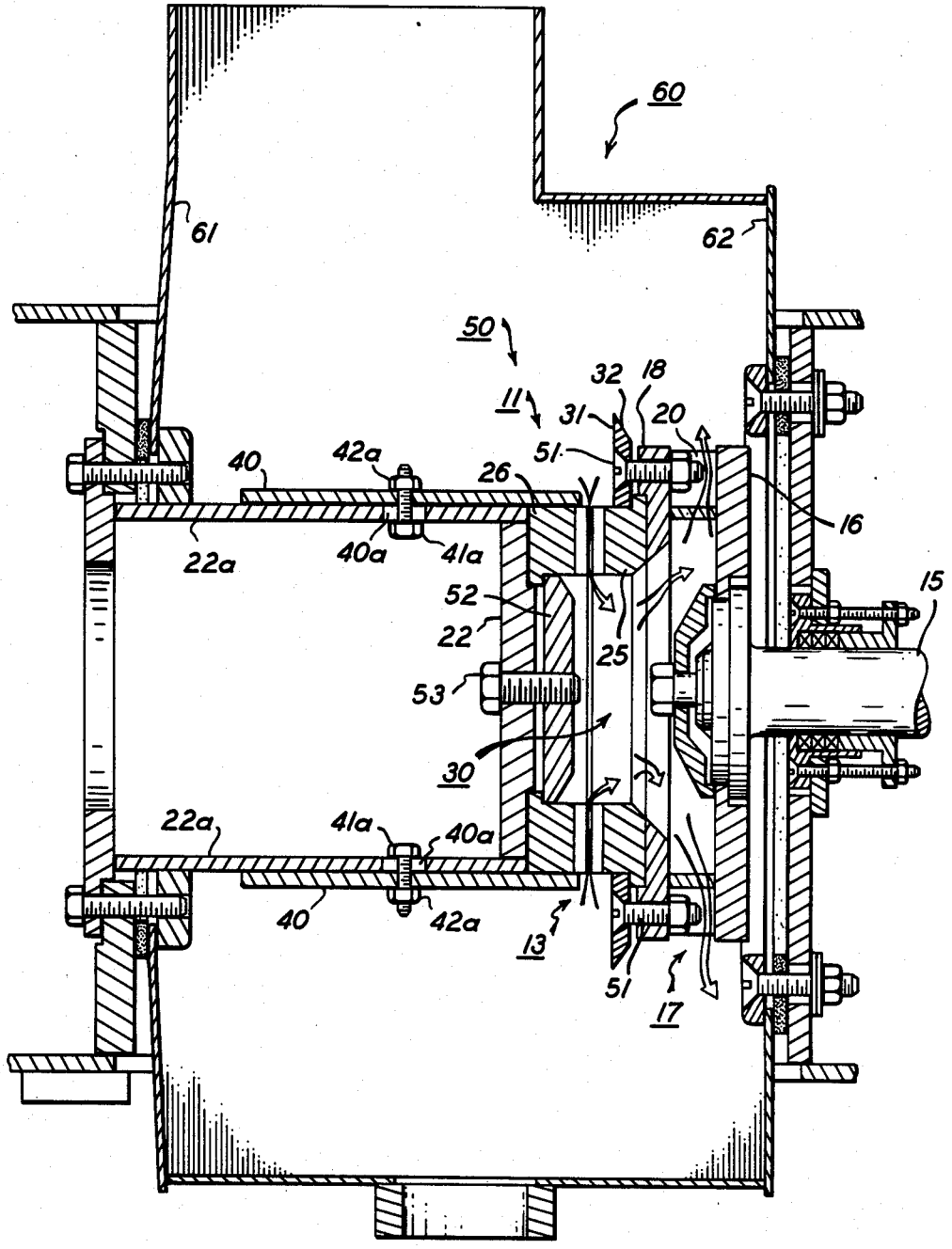
FIG. 8 is a partially schematic, cross-sectional view of another preferred embodiment of a pumped attrition disk device according to my invention.

Another embodiment of attrition device 50 is arranged as shown in FIG. 8 for using my invention. Many components of attrition device 50 are similar to those already explained including rotor 10 and stator 11. Instead of rotor shaft 15 extending through stator 11, rotor shaft 15 extends through a mount on wall 62 of a container 60, and stator 11 is mounted on wall 61 opposite wall 62. This makes the confronting working bars on rotor filling 25 and stator filling 26 meet between the rotor and stator wall mounts in a disk-shaped, annular attrition zone 13 positioned within container 60. It also removes rotor shaft 15 from hollow rotor interior 30 and disposes centrifugal pumping zone 17 between attrition zone 13 and shaft mount wall 62.

Rotor plate 16 is preferably clamped to the end of rotor shaft 15 to hold pumping vanes 20 between end plate 16 and annular plate 18 as illustrated. Cutter plate 31, attached to plate 18 by bolts 51, holds rotor filling 25 in place and also provides cutting edges 32. Clamp 52 held by bolt 53 holds stator filling 26 in place. Guard ring 40 for setting the depth of space available between stator bars is formed as an axially adjustable sleeve surrounding stator filling 26. A cylindrical tube **22*a* holding stator base plate 22 has longitudinal adjusting slots 40*a* through which screws 41*a* extend to thread through nuts 42*a* welded to stator guard sleeve 40 for adjustment axially of the attrition zone. Adjustment scales, screws, and more elaborate mechanisms can also be used for positioning guard ring 40** axially to set the depth of space available between stator bars.

The arrangement of FIG. 8 opens up hollow rotor interior 30 by eliminating shaft 15 and assuring full input flow to pumping zone 17 so that no cavitation occurs. It also eliminates any partial vacuum between rotor 10 and rotor wall 62. This simplifies packing glands, bearings, and axial adjustment mechanisms to set the width of the gap in the disk plane of attrition zone 13.

Working Bars

Attrition zone 13 should have as many working bars as practical to produce the largest number of bar crossings per revolution and thereby accomplish maximum work as the rotor turns. This has led in the past to working bars with rectangular cross-sectional shapes so the bars can be as stout and sturdy as possible and as closely spaced as practical. Also, workers in the disk attrition art have believed that leading bar surfaces nearly perpendicular to the plane of the attrition zone provide the most effective working surfaces possible.

I have discovered that inclining the leading surfaces of the working bars by an acute angle to the plane of the attrition zone produces surprising advantages, even though it reduces the number of bars that can be arranged within a given space. I found that fibers entering the outside of attrition zone 13 can wrap around outer ends of bars that have a rectangular cross-sectional shape and, by lodging on the bar ends, can clog the entry to the attrition zone. For center feeding attrition zones, this can be avoided by giving the entry ends of the tops of the bars long, thin tapers leading to the plane of the attrition zone gap. That is not practical, however, for slurried fibers entering an outer perimeter 34 of attrition zone 13. Sloping the leading rotational surfaces of the radially outer regions of the working bars as shown in FIGS. 3–7 not only solves the problem of fibers wrapping around bar ends, but offers other advantages as well.

Although the sloped stator bar surfaces 38 and rotor bar surfaces 48 can extend for the full length of each bar, the fiber wrapping problem can be solved by sloping only the radially outer regions of the rotor and stator bars. This can be done by grinding a bevel on the leading edge of the outer end of each stator bar 35 and rotor bar 45.

Extending the sloped leading surfaces 38 and 48 for the full length of respective stator bars 35 and rotor bars 45 as illustrated leaves the bars separated by grooves 36 and 46 that preferably deepen as they extend from inner perimeter 33 to outer perimeter 34. Also, the working edges 37 and 47 of the stator and rotor bars are preferably angled slightly from radial so that they scissor together, rather than clash. Trailing bar edges 39 and 49 are preferably approximately perpendicular to the plane of attrition zone 13 although a small angle for draft is required if fillings 25 and 26 are formed as annular castings as preferred.

Figure 5:
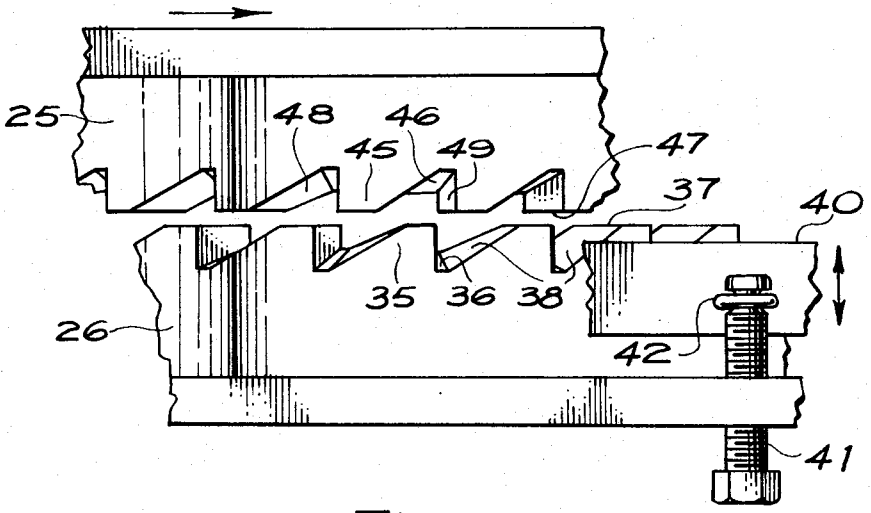
FIG. 5 is an enlarged, fragmentary elevational view of the outer periphery of a preferred configuration of working bars in an attrition zone for the device of FIGS. 1 and 2.

Although stator and rotor working bars can have different configurations, it is often convenient to make them identical as shown in FIG. 5. Then rotor filling 25 can be the same as the stator filling 26 illustrated in FIGS. 3 and 4.

The preferred slope angles a and b for the leading surfaces of stator and rotor bars are each acute angles to the plane of attrition zone 13 and are each preferably within the range of 30° to 60°. Material encountering the sloped leading surface of the outer extremity of a working bar is then urged along the slope toward the working edge 37 or 47 in the plane of the attrition zone gap where it encounters a confronting bar. This action can nibble away bits of a large fiber clump, each time it encounters the entry to the attrition zone. Since the sloped leading edges prevent fiber lodgment, the bars either draw fibers up the slope into the attrition zone plane for working or cast off fiber clumps or foreign objects too large to enter the attrition zone.

Radially outer end surfaces 35E and 45E of the stator and rotor bars preferably lie in a cylindrical locus that is interrupted by grooves 36 and 46 formed between bar ends 35E and 45E. The dynamic effect is a periodically interrupted cylindrical barrier to entry of contaminants into the attrition zone. Especially larger objects experience the bar ends as a cylindrical wall through which small entrance openings in the form of fixed stator grooves 46 and rotating rotor grooves 36 afford little opportunity for entry into the attrition zone. This, combined with the ability of bar ends 35E and 45E to nibble small bits from large fiber clumps and the ability of sloped leading surfaces 38 and 48 to avoid fiber lodgment, keeps large fiber clumps and contaminants out of the attrition zone and yet enables the device to defiber objects and materials that have previously been recalcitrant.

Figure 6:
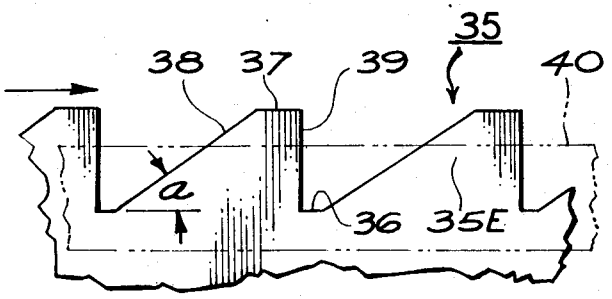

The discovery that material entering the attrition zone passes mostly between stator bars 35 allows the material being processed to be controlled with a simple guard 40 encircling stator element 26 as shown in FIGS. 5 and 6. Guard ring or strip 40 encircles stator element 26 and can be axially adjusted by screws 41 to open or restrict the space available in grooves 36 between bars 35. Moving guard 40 to a position near working edges 37 restricts entry into the attrition zone to finer material and excludes unwanted materials such as plastics or other contaminants that should not be broken into small pieces. Positioning guard 40 to open the access to grooves 36 admits larger pieces of material or groups of fibers into the attrition zone for processing and makes device 10 more aggressive. Since stator 11 is not moving, guard 40 can be axially adjusted during operation while results are observed. Guard 40 is also simpler than a cleaning bonnet and more easy to adjust for adapting device 10 to work on different materials. It also allows device 10 to work on contaminated furnish without shredding plastics and other contaminants into the pulp.

Operation

My attrition device 10 or 50 can be operated with shaft 15 vertical, horizontal, or at some other angle; and it can be mounted in tanks or chambers that vary in size or shape, depending on objectives. As a small laboratory model, my attrition machine can process small amounts of materials to determine what can be pulped, refined, or processed; what power, time, attrition zone gap, and other parameters will be required; and what settings for guard 40 are workable with different materials. Device 10 or 50 can operate as a refiner in a chamber through which pulped material flows; and it can operate to pulp, defiber, and process a wide variety of materials.

A working prototype has achieved unique results in defibered cotton shirts, rags, surgical gowns, flakes, shives, and wood chips. It works rapidly and aggressively with these materials, completing the defibering in less time and with less energy than previous devices. My device can also pulp nonwoven fibers, many different varieties of organic fibers, and some synthetic fibers.

Cutting edge 32 is useful for cutting large fibrous objects into smaller swatches that can be defibered more rapidly. Working bars at the outer permeter 34 of the attrition zone nibble and tear at fiber clumps and quickly pick larger pieces into bits that can pass through the attrition zone. Once materials are reduced to fragments small enough to flow through the attrition gap, complete defibering occurs quickly because of the rapid and repeated flow of material between the working bars.

The sloped leading edges 38 and 48 of the outer ends of the working bars combined with an unobstructed, hollow interior and rounded pump vanes 20 avoid all fiber lodgment and keep the rotor and stator clean during operation. The adjustable guard around the grooves between the stator bars allows the machine to be adjusted during operation to exclude contaminants from the attrition zone.

Experimental work thus far has shown my attrition device to be more aggressive, versatile, and efficient than previous pulpers. It can defiber large objects and some types of fibrous materials that conventional pulpers cannot work. It may also be usable for processing materials not yet tried.

I claim:

1. In an attrition device having an attrition zone formed between a stator and rotor having annularly arrayed confronting bars contiguously separated by grooves, said attrition device being arranged within a tank of wetted and unpumpable fiber material that may contain contaminants, an improvement making said attrition zone self-cleaning while said attrition zone defibers said unpumpable material, said improvement comprising:

a. said rotor having a hollow interior that is enclosed between an inner periphery of said attrition zone and an annular discharge region;

b. impeller vanes arranged within said annular discharge region to pump slurry from said hollow rotor interior radially outward through said discharge region and thereby to pull fiber clumps of said material into an outer periphery of said attrition zone, flow said fiber clumps radially inward through said attrition zone against the outward pumping force of said confronting bars, and draw said slurry from said inner periphery of said attrition zone through said hollow rotor to said discharge region;

c. radially outer ends of said bars on said rotor and stator at said outer periphery of said attrition zone lying in a cylindrical locus and presenting an interrupted cylindrical barrier to entry of said contaminants into said attrition zone; and d. leading surfaces of said bars at said outer periphery being sloped to prevent fibers from wrapping around outer ends of said bars.

2. The improvement of claim 1 wherein said rotor interior is unobstructed by any radially extending elements, and radially inner extremities of said impeller vanes are sufficiently rounded to avoid fiber lodgment.

3. The improvement of claim 1 wherein the outside diameter of said impeller vanes is larger than the outside diameter of said attrition zone.

4. The improvement of claim 1 wherein said slope of said leading surfaces of said bars is from 30° to 60° from the plane of a gap between said confronting bars of said rotor and stator.

5. The improvement of claim 1 including a guard ring around an outer periphery of said stator and means for axially adjusting said guard ring relative to said stator bars to set a depth of space available for said fiber clumps to enter between said stator bars.

6. The improvement of claim 1 wherein said closed interior of said rotor is shaped so that said slurry makes an annular U-turn between said inner periphery of said attrition zone and said annular discharge region.

7. The improvement of claim 1 including means for axially adjusting the width of a gap between said confronting bars of said rotor and stator in said attrition zone.

8. A self-cleaning attrition device immersed in a container of wetted and unpumpable fiber material for defibering said material into a slurry, said attrition device comprising:

a. a stator and rotor having bars contiguously separated by grooves to confront in an annular, disk-shaped attrition zone arranged within said container;

b. a wall mount through which a shaft for said rotor extends into said container;

c. another wall mount supporting said stator within said container;

d. said wall mounts being arranged on opposite wall regions of said container so that said attrition zone is between said opposite wall mounts;

e. said rotor having a hollow interior that is enclosed between an inner periphery of said attrition zone and an annular peripheral discharge region;

f. impeller vanes arranged within said annular discharge region for moving said slurry radially outward through said discharge region and thereby drawing fiber clumps of said material radially inward through said attrition zone and through said hollow rotor interior; and g. leading surfaces of said bars at said outer periphery of said attrition zone being sloped to prevent fibers from wrapping around outer ends of said bars.

9. The attrition device of claim 8 wherein said discharge region is axially spaced from said attrition zone so that said slurry flows in an annular U-turn through said hollow interior of said rotor.

10. The attrition device of claim 8 wherein the outside diameter of said impeller vanes is larger than the outside diameter of said attrition zone.

11. The attrition device of claim 8 wherein said slope of said bars at said outer periphery is 30° to 60° from the plane of a gap between said confronting bars of said rotor and stator.

12. The attrition device of claim 8 including a guard ring around an outer periphery of said stator and means for axially adjusting said guard ring relative to said stator bars to set a depth of sapce available for said fiber clumps to enter between said stator bars.

13. The attrition device of claim 8 including means for axially adjusting the width of a gap between said confronting bars of said rotor and stator in said attrition zone.

14. A self-cleaning attrition zone immersed in a container of wetted and unpumpable fiber material that may contain contaminants so that said attrition zone can defiber said material into a slurry, said self-cleaning attrition zone comprising:

a. a rotor and stator having bars contiguously separated by grooves to confront in an annular array;

b. impeller vanes arranged wtihin an annular discharge from said rotor, which has an enclosed and hollow interior so that said impeller vanes force slurry from said hollow interior radially outward through said annular discharge and thereby draw fiber clumps of said material radially inward through said attrition zone from an outer periphery of said attrition zone and through said hollow interior to said discharge;

c. said rotor interior being unobstructed by any radially extending elements, and radially inner extremities of said impeller vanes being sufficiently rounded to avoid fiber lodgment;

d. radially outer ends of said bars on said rotor and stator at said outer periphery of said attrition zone lying in a cylindrical locus and presenting an interrupted cylindrical barrier to entry of said contaminants into said attrition zone; and e. leading surfaces of said bars at said outer periphery of said attrition zone being sloped from the plane of a gap between said rotor and stator bars so as to prevent fibers from wrapping around outer ends of said bars.

15. The attrition zone of claim 14 wherein said slope of said leading surfaces of said bars is from 30° to 60° from the plane of said gap.

16. The attrition zone of claim 14 including means for axially adjusting the width of said gap in said attrition zone.

17. A self-cleaning attrition device immersed in a tank of wetted and unpumpable fiber material that may contain contaminants, said self-cleaning attrition device comprising:

a. a rotor and stator having bars contiguously separated by grooves to confront in an annular array in an attrition zone;

b. radially outer ends of said bars on said rotor and stator at an outer periphery of said attrition zone lying in a cylindrical locus and presenting an interrupted cylindrical barrier to entry of contaminants into said attrition zone;

c. leading surfaces of said bars at said outer periphery being sloped at 30° to 60° from the plane of an attrition zone gap between said rotor and stator bars so that fiber material does not wrap around said outer ends of said bars;

d. said rotor having a hollow interior that is enclosed between an inner periphery of said attrition zone and a centrifugal annular discharge region; and e. impeller vanes arranged around said rotor within said annular discharge region for moving small clumps of said fiber material radially inward through said attrition zone, through said hollow rotor, and radially outward through said discharge region.

18. The attrition device of claim 17 arranged for flowing said clumps of said material in an annular Uturn between said inner periphery of said attrition zone and said annular discharge region.

19. The attrition device of claim 17 including means for axially adjusting the width of said attrition zone gap between said rotor and stator bars.

20. The attrition device of claim 17 wherein a guard ring around an outer periphery of said stator is axially adjustable to set a depth of space available for said clumps to enter between said stator bars.

21. A pulper for pulping unpumpable and wetted fiber material that may contain contaminants, said pulper comprising:

a. a rotor and stator arranged within a tank for said unpumpable material so that bars on said rotor and stator are contiguously separated by grooves and confront in an annular, disk-shaped attrition zone;

b. said rotor having a hollow interior that is enclosed between an inner periphery of said attrition zone and an annular peripheral discharge region axially spaced from said attrition zone;

c. impeller vanes arranged within said discharge region of said rotor for forcing defibered material radially outward through said discharge region to draw fiber clumps from said material radially inward through said attrition zone to become defibered and pass through said hollow rotor; and d. the leading surfaces of outer regions of said bars being sloped so that fibers cannot wrap around outer ends of said bars.

22. The pulper of claim 21 wherein said leading surfaces of said bars are sloped by 30° to 60° from the plane of said attrition zone.

23. The pulper of claim 21 including means for axially adjusting the width of a gap between said rotor and stator bars in said attrition zone.

24. The pulper of claim 21 wherein a guard ring around the outer periphery of said stator bars is axially adjustable to set a depth of space available for said material to enter between said stator bars.

25. The pulper of claim 21 wherein said rotor and said stator are mounted on opposite walls of said tank.

26. A self-cleaning attrition device immersed in a tank for defibering wetted and unpumpable fiber material filling said tank and possibly containing contaminants, said self-cleaning attrition device comprising:

a. a rotor and stator having bars contiguously separated by grooves to confront in an annular array forming an attrition zone;

b. impeller vanes arranged within an annular discharge region of said rotor, said rotor being hollow and closed between said annular discharge region and an inner periphery of said attrition zone axially spaced from said annular discharge region so that said impeller vanes draw fibers, but not said contaminants, radially inward through said attrition zone; and c. leading surfaces of outer regions of said bars being sloped 30° to 60° relative to the plane of said attrition zone so that fibers cannot wrap around outer ends of said bars.

27. The self-cleaning attrition device of claim 26 including means for axially adjusting the width of a gap between said rotor and stator bars in said attrition zone.

28. The self-cleaning attrition device of claim 26 wherein an outside diameter of said impeller vanes is larger than an outside diameter of said attrition zone.

29. The self-cleaning attrition device of claim 26 including a guard ring around an outer periphery of said stator and means for axially adjusting said guard ring relative to said stator bars to set a depth of space available for said fibers to enter between said stator bars.

* * * * *